US006059540A

United States Patent [19]

Ni

[11] Patent Number: 6,059,540

[45] Date of Patent: May 9, 2000

[54] LUBRICATION MEANS FOR A SCROLL-TYPE FLUID DISPLACEMENT APPARATUS

[75] Inventor: Shimao Ni, Willowbrook, Ill.

[73] Assignee: Mind Tech Corp., Willowbrook, Ill.

[21] Appl. No.: 08/935,230

[22] Filed: Sep. 22, 1997

[51] Int. Cl.[7] ..... F04B 49/00

[52] U.S. Cl. ..... 417/295; 417/228; 418/55.2-55.6

[58] Field of Search ..... 417/295, 228; 418/55.2, 55.6, 85, 89

[56] References Cited

U.S. PATENT DOCUMENTS

| | | | |
|---|---|---|---|
| 801,182 | 10/1905 | Creux . | |
| 3,482,768 | 12/1969 | Cirrincione et al. | 417/295 |
| 3,600,114 | 8/1971 | Dvorak et al. . | |
| 3,874,827 | 4/1975 | Young . | |
| 3,884,599 | 5/1975 | Young et al. . | |
| 3,924,977 | 12/1975 | McCullough . | |
| 3,989,422 | 11/1976 | Guttinger . | |
| 3,994,633 | 11/1976 | Shaffer . | |
| 3,994,636 | 11/1976 | McCullough et al. . | |
| 4,063,855 | 12/1977 | Paul | 418/85 |
| 4,082,484 | 4/1978 | McCullough . | |
| 4,216,661 | 8/1980 | Tojo et al. . | |
| 4,357,132 | 11/1982 | Kousokabe . | |
| 4,437,820 | 3/1984 | Terauchi et al. . | |
| 4,477,238 | 10/1984 | Terauchi . | |
| 4,496,296 | 1/1985 | Arai et al. . | |
| 4,527,964 | 7/1985 | Mitsui et al. . | |
| 4,558,997 | 12/1985 | Sakata et al. . | |
| 4,609,334 | 9/1986 | Muir et al. . | |
| 4,611,975 | 9/1986 | Blain . | |
| 4,642,034 | 2/1987 | Terauchi | 417/295 |
| 4,676,075 | 6/1987 | Shiibayashi | 418/55.6 |
| 4,877,382 | 10/1989 | Caillat et al. . | |
| 4,958,993 | 9/1990 | Fujio | 418/55.6 |
| 5,102,316 | 4/1992 | Caillat et al. . | |
| 5,395,222 | 3/1995 | Kawahara et al. | 418/55.2 |
| 5,458,471 | 10/1995 | Ni . | |
| 5,806,630 | 9/1998 | Bernal | 184/6.26 |

FOREIGN PATENT DOCUMENTS

| | | | |
|---|---|---|---|
| 60-98185 | 6/1985 | Japan . | |
| 3-11102 | 1/1991 | Japan . | |
| 3-237283 | 10/1991 | Japan . | |
| 4-5490 | 1/1992 | Japan . | |
| 4-121482 | 4/1992 | Japan . | |
| 405187371 | 7/1993 | Japan | 418/55.2 |

*Primary Examiner*—Charles G. Freay
*Assistant Examiner*—Cheryl J. Tyler
*Attorney, Agent, or Firm*—Richard G. Lione; Brinks Hofer Gilson & Lione

[57] ABSTRACT

A scroll-type fluid displacement apparatus has two interfitting spiral-shaped scroll members which have predetermined geometric configurations. The novel design provides an oil-gas separation and circulation system in which the oil, through a reservoir in the close proximity of the thrust bearing and metering orifices network, is properly and promptly directed to the scroll compression chamber, Oldham ring and bearings to provide lubrication and cooling. This invention also provides a notch mechanism at the tip of the orbiting scroll member during operation to avoid the orbiting scroll wrap from completely blocking the oil injection ports of small size on the fixed scroll base. This invention further relates to a gas intake system which directs gas from the oil-gas separator/sump to close the intake control valve and maintain low power consumption during unload mode. When the compressor shuts off, the system enable pressure inside scroll compressor to quickly reach balance and makes the compressor ready for restart.

9 Claims, 6 Drawing Sheets

LUBRICATION MEANS FOR A SCROLL-TYPE FLUID DISPLACEMENT APPARATUS

FIELD OF INVENTION

This invention relates in general to a fluid displacement device. More particularly, it relates to an improved scroll-type fluid displacement device

BACKGROUND OF THE INVENTION

Scroll-type fluid displacement devices are well known. For example, U.S. Pat. No. 801,182 to Leon Creux, discloses a scroll device including two scroll members each having a circular end plate and a spiroidal or involute scroll element. These scroll elements have identical spiral geometry and are interfit at an angular and radial offset to create a plurality of line contacts between their spiral curved surfaces. Thus, the interfit scroll elements seal off and define at least one pair of fluid pockets. By orbiting one scroll element relative to the other, the line contacts are shifted along the spiral-curved surfaces, thereby changing the volume of the fluid pockets. This volume increases or decreases depending upon the direction of the scroll elements' relative orbital motion and, thus, the device may be used to compress or expand fluids.

U.S. Pat. No. 4,676,075 to Masao Shiibayashi discloses a scroll-type device wherein an oil injection system is used which includes injection ports whose size is greater than the thickness of the scroll wrap. This prevents the injection ports from being completely blocked by the wrap of the orbiting scroll. However, an injection port with a large diameter can create significant leakage of gas from compression chambers at higher pressure to those at lower pressure. Particularly, during start up when the pressure in the oil sump is lower than the pressure in the intermediate compression chamber where the oil injection port is located, the gas in the intermediate compression chamber will flow in the opposite direction, i.e. through the oil injection port to the oil sump. This blocks the oil flow from the oil sump to the compression chamber and results in overheating of the compressor.

In some devices it is impossible for oil injection ports to be larger than the thickness of the scroll wrap. For instance, the scroll geometry incorporated in the device disclosed in the U.S. Pat. No. 5,458,471 to Shimao Ni employs variable vane thickness (see FIGS. 2 and 3). The portion of the orbiting scroll wrap by which the oil injection ports on the fixed scroll member would be covered is so thick that the oil injection port size cannot practically be larger than the corresponding thickness of the orbiting scroll wrap without seriously hurting compressor performance.

SUMMARY OF THE INVENTION

To overcome the shortcomings of the above-mentioned patents and to fully take advantage of scroll type devices, an object of the present invention is to provide an oil-gas separation and circulation system. In the system the oil is properly directed during operation, and promptly directed during starting period, through a series of throttling orifices to scroll compression chambers, an Oldham ring and bearings for lubrication and cooling.

Another object of the invention is to provide a mechanism at the tip of the orbiting scroll member to prevent the orbiting scroll wrap from completely blocking the oil injection port on the fixed scroll base at any time.

A further object of the invention is to provide a gas intake system which directs gas from the oil-gas separator/sump to close the intake control valve and maintain low power consumption during unload mode, and when the compressor shuts makes it ready for restart.

In order to implement these and other objects, the present invention includes a scroll-type fluid displacement device comprising a housing having a fluid inlet port. A first scroll member has an end plate from which a first scroll element axially extends into the interior of the housing. A second scroll member has an end plate from which a second scroll element also axially extends into the housing. The second scroll member is mounted for non-rotational, orbital movement relative to the first scroll member.

The first and second scroll element interfit at angularly and radially offset line contacts to define at least one pair of sealed fluid pockets. A drive mechanism including a main shaft is operatively connected to the scroll members to effect relative orbiting motion while preventing its relative rotation, thus causing the fluid pockets to change volume.

An oil-air separation and circulation system has an oil-air separator, a coalescent filter, an oil cooler, an oil temperature control device, an oil filter, an oil reservoir and pipes which connect them with a series of throttling orifices. This system separates oil from gas flow. The system also cools the oil to a preset temperature, filters the oil and then directs proper amounts of oil back to compression chambers, thrust bearing and shaft bearings. Gas separated from the oil flows through a gas cooler to the service port. An air intake control valve opens when the air supply is demanded, and closes off when the air supply is not demanded and the compressor is in unload, or off mode.

The present invention also provides an oil-gas separation and circulation system having an oil-reservoir which is located near the thrust bearing and shaft bearings. It also has oil passages with orifices for metering oil flow. Properly during operation, and promptly during starting period, the system directs the oil to the scroll compression chambers, Oldham ring and bearings to provide lubrication and cooling.

The present invention also includes a notch mechanism at the tip of the orbiting scroll member which connects the oil injection ports to compression chambers. This prevents the orbiting scroll wrap from completely blocking the oil injection port on the fixed scroll base.

The present invention also includes a gas intake system which, during unload mode, directs the gas from the oil-gas separator/sump to the intake valve in order to close the suction valve. The system also discharges excessive gas caused by unavoidable leakage of the intake valve or shaft seal, and muffles discharge noise. When the compressor shuts-off, the intake system quickly balances the pressure inside the scroll compressor and makes it ready for restart.

BRIEF DESCRIPTION OF THE DRAWINGS

The invention will be better understood when considered in view of the following detailed description that makes reference to the annexed drawings in which.

DETAILED DESCRIPTION OF THE PRESENTLY PREFERRED EMBODIMENTS

Figure 1:
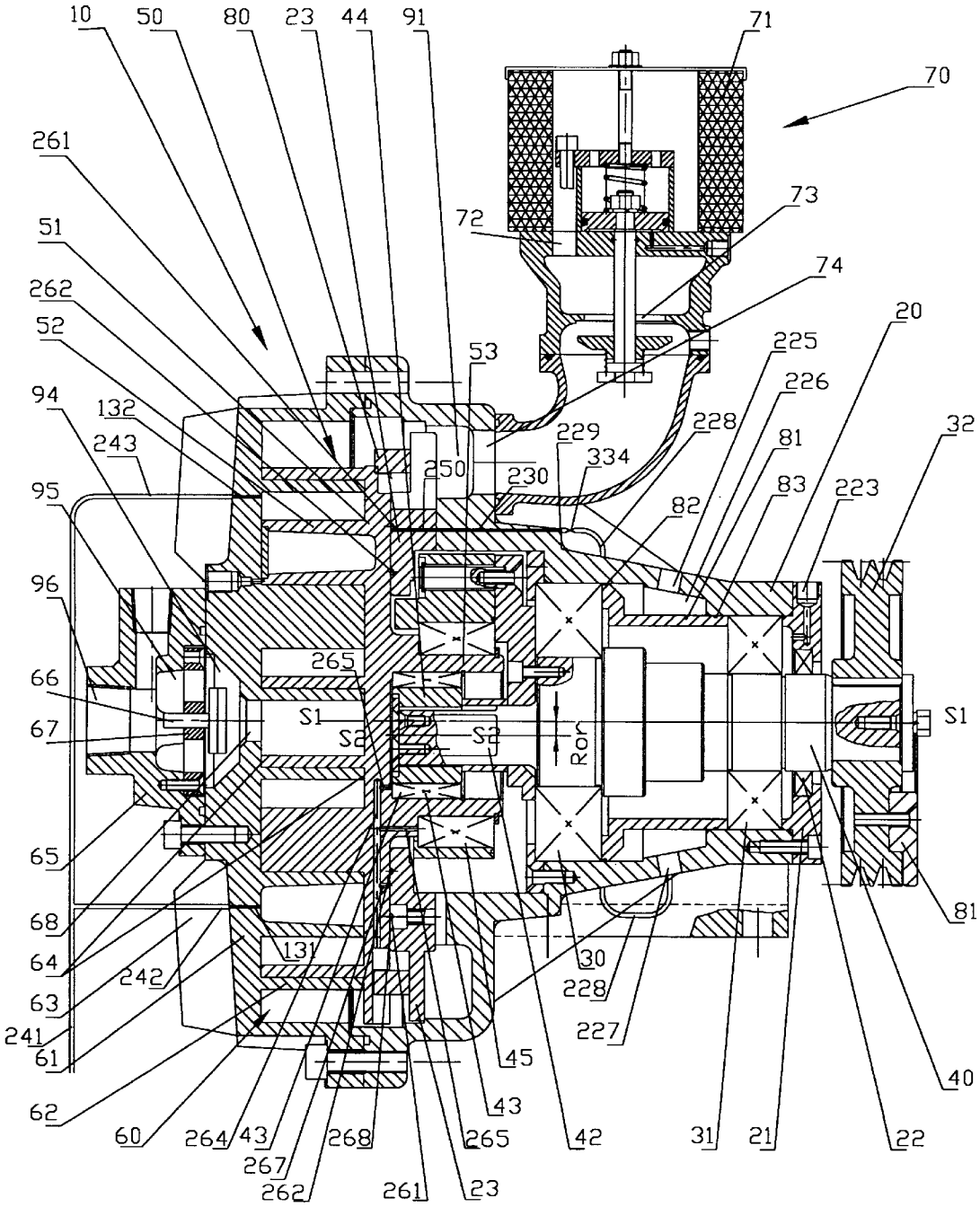
FIG. 1 illustrates a cross section of a scroll-type air compressor embodying features the present invention.

Referring to FIG. 1, a scroll-type air compressor unit embodying features of the present invention is shown generally at 10. The compressor unit 10 includes a main housing 20. A rear cover 21 with a shaft seal 22 is attached to the main housing 20 in a conventional manner (e.g. bolting).

The housing 20 holds front bearing 30 and rear bearing 31. A main shaft 40 is rotatably supported by bearings 30 and 31 and rotates along its axis S1—S1 when driven by an electric motor (see FIG. 4) or engine (not shown) via a pulley 32. The shaft seal 22 seals the shaft 40 to prevent lubricant and air inside the housing from escaping and outside air and dirt from entering.

A drive pin 42 protrudes from the front end of main shaft 40. The central axis S2—S2 of the drive pin is offset from the main shaft axis S1—S1 by a distance equal to the orbiting radius $R_{or}$ of the second scroll element 50 relative to the first scroll element 60. The radius $R_{or}$ is the radius of the circle which is traversed by the second scroll member 50 as it orbits around to the first scroll member 60.

The first scroll member 60, which is the fixed scroll, includes a circular end plate 61 from which a scroll element 62 extends. The first scroll member 60 is attached to the main housing 20. The first scroll member 60 also includes reinforcing ribs 63.

A discharge connector 65 is attached to the first scroll member 60. A check valve 66 and a check valve guide 67 are located in the discharge connector 65. During operation of the compressor unit, the check valve 66 opens a discharge path 68 on the first scroll member 60. When the compressor unit 10 stops, the check valve 66 closes the discharge port 68.

The second scroll member 50, which is the orbiting scroll, includes a circular end plate 51, a scroll element 52 and an orbiting bearing boss 53. Scroll element 52 is affixed to, and extends from the front surface of, the end plate 51. The orbiting bearing boss 53 is affixed to, and extends from, the rear surface of the end plate 51.

Scroll elements 52 and 62 are interfit at a 180 degree angular offset and at a radial offset which creates an orbiting radius $R_{or}$. At least one pair of sealed-off, fluid pockets is thereby defined between the scroll elements 52 and 62 and the end plates 51 and 61. The scroll elements are in interfit so that suitable gaps 64 remain between the top of one scroll element and the end plate of the other.

The second scroll member 50 is connected to a driving pin 42 through a driving pin bearing 43 and a driving slider 44. It is also connected to a rotation preventing Oldham ring 80. The second scroll member 50 is driven in an orbital motion at the orbiting radius $R_{or}$ by rotation of the drive shaft 40 to thereby compress fluid.

The working fluid, air in this case, enters the compressor unit 10 from the intake valve 70. More specifically, the air passes an air filter 71, an inlet passage 72, an intake valve opening 73, and in inlet port 74. It then enters the inlet air passage 91. The inlet air passage 91 is formed between housing 20 and thrust bearing 23.

From the inlet air passage 91, the air enters the suction pockets formed by the two scroll members. The air then is compressed by the relative motion of the two scroll members. The compressed air discharges through discharge hole 68, chamber 94, passage 95 and discharge port 96.

An oil reservoir 226 is formed between the housing 20 and spacer 81. "O" rings 82 and 83 seal off the oil reservoir 226 from the remaining area inside the housing 20. The oil reservoir 226 has an inlet port 225 and an outlet port 227. It stores oil to insure that oil is immediately available during start up, and can be promptly supplied to shaft bearings 30,31 and thrust surface 268, in a manner hereinafter discussed.

Figure 2A:
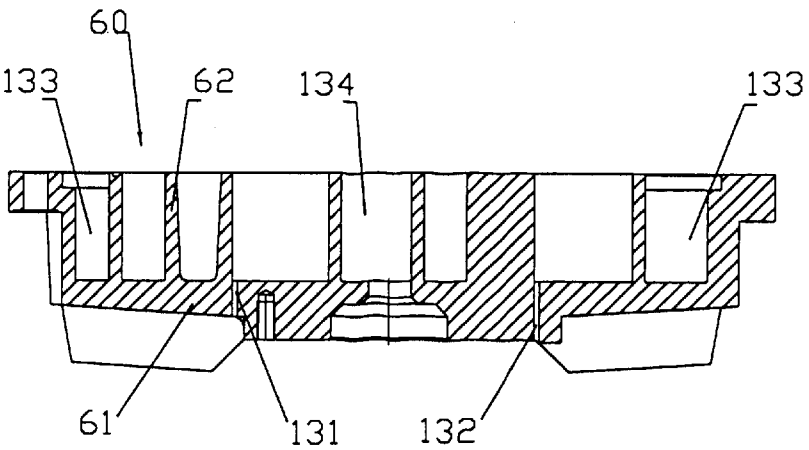
FIG. 2A illustrates a section A—A through FIG. 2.
Figure 2:
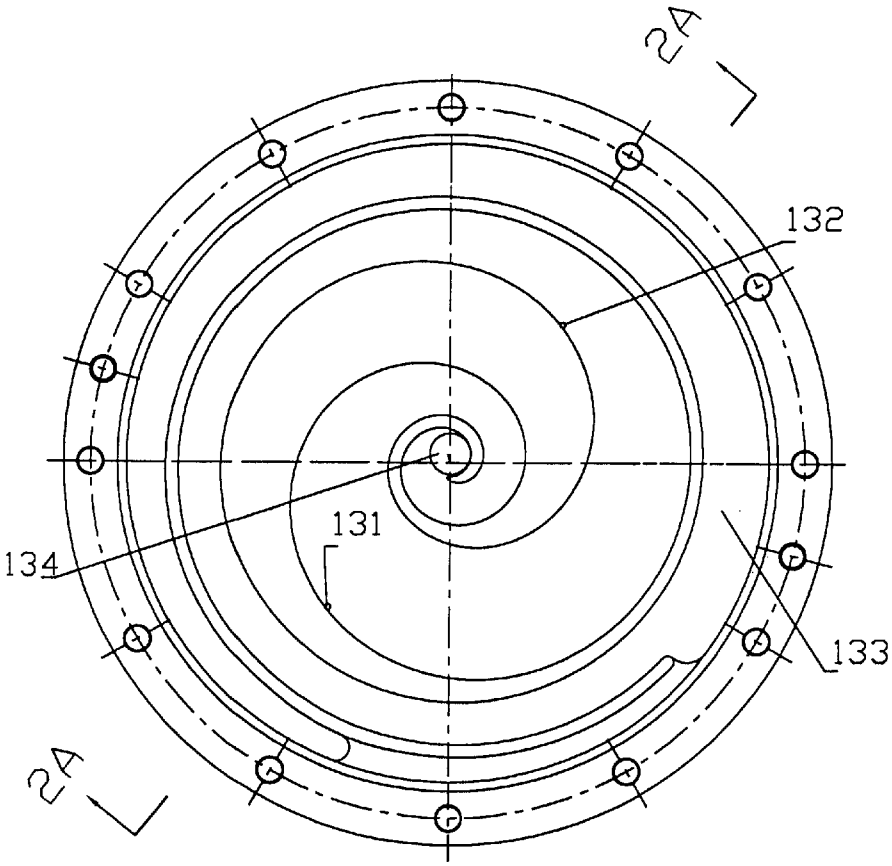
FIG. 2 illustrates the first scroll member in compressor of FIG. 1.

Referring now to FIGS. 2 and 2A, there is shown a pair of oil injection ports 131 and 132 on the base of the first scroll member. The ports 131 and 132 are positioned so that they connect directly to neither the suction passage 133 nor the discharge chamber 134. The ports 131 and 132 are positioned 180° of involute angle apart.

The size of ports 131 and 132 is of importance for metering the flow rate of injected oil, according to this invention. The larger the port size, the larger the amount of oil injected and, as a result, the better the sealing and cooling provided. However, the larger the amount of oil injected, the larger the power consumption. Even worse, an excessive amount of oil injected can cause a liquid hammer effect, leading to damage of the scroll elements and the Oldham ring. Therefore, the port size must be properly selected and should not be enlarged to the size suggested in U.S. Pat. No. 4,676,075 to Masao Shiibayashi.

Sometimes, where the thickness of the spiral wrap is very large, as seen in U.S. Pat. No. 5,458,471 to Shimao Ni (commonly assigned with the present application and specifically incorporated herein by reference), it is impossible for the port size to be larger than the thickness of the wrap. In order to avoid the complete blockage of the oil injection ports by the spiral wrap of the second scroll member during its orbiting motion, notches are made at the tip of second scroll element.

Figure 3B:
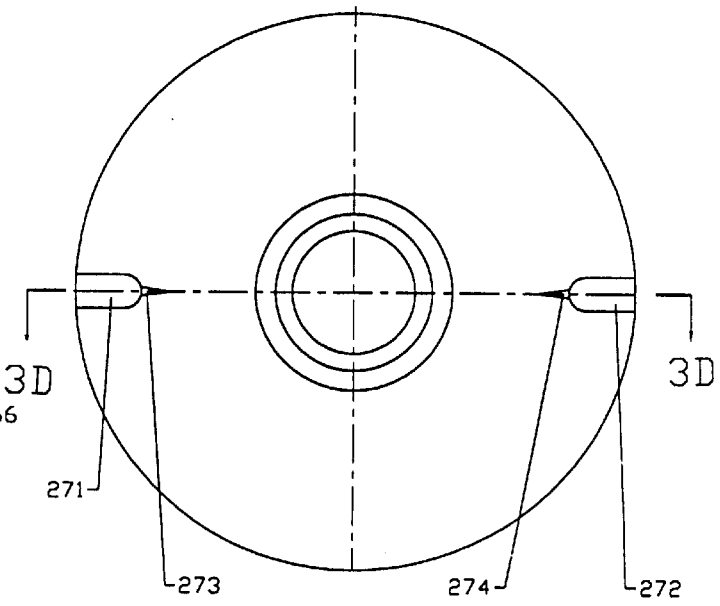
FIG. 3B is a back view of the scroll member of FIG. 3.
Figure 3D:
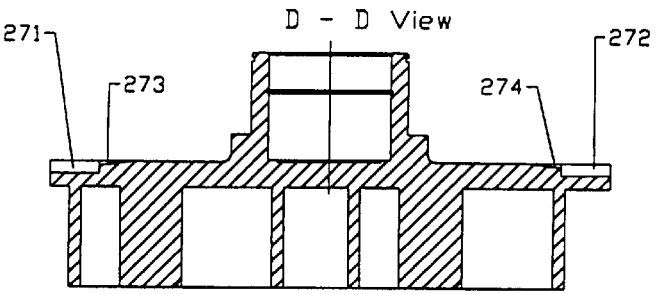
FIG. 3D illustrates a section D—D through FIG. 3B.
Figure 3A:
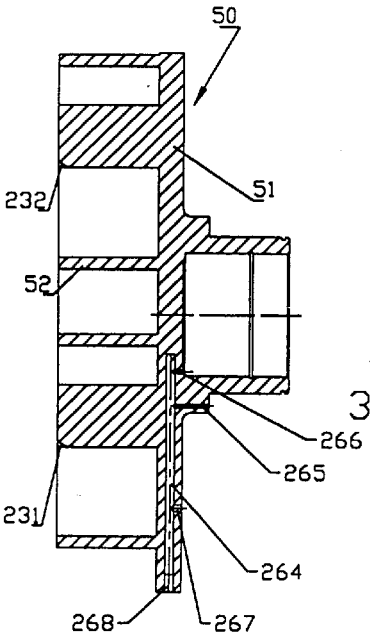
FIG. 3A illustrates a section A—A through FIG. 3.
Figure 3C:
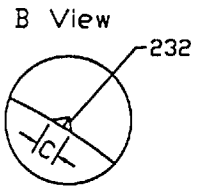
FIG. 3C is an enlarged view of the circled area in FIG. 3.
Figure 3:
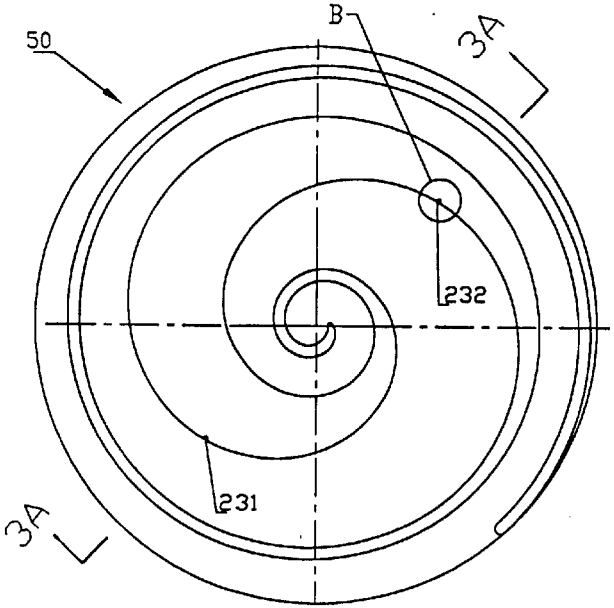
FIG. 3 illustrates the second scroll member in the compressor of FIG. 1.

FIGS. 2 and 3 show oil injection ports 131 and 132 which are smaller in diameter than the thickness of the corresponding scroll wrap. In order to prevent the periodic blockage of the ports by the second scroll element 52, notches 231 and 232 are formed in the tip of the second scroll element. During the orbiting motion, these notches 231 and 232 pass over the oil injection ports 131 and 132. The width of the notch, indicated by "c" in FIG. 3C, is larger then the diameter of the corresponding oil injection port. When passing over the ports 131 and 132, respectively, notches 231 and 232 connect ports 131 and 132 to either the upstream or downstream compression chambers, or to both, to prevent the orbiting scroll element from completely blocking the corresponding oil injection ports. This prevents pulsation and vibration in the oil injection lines.

Figure 4:
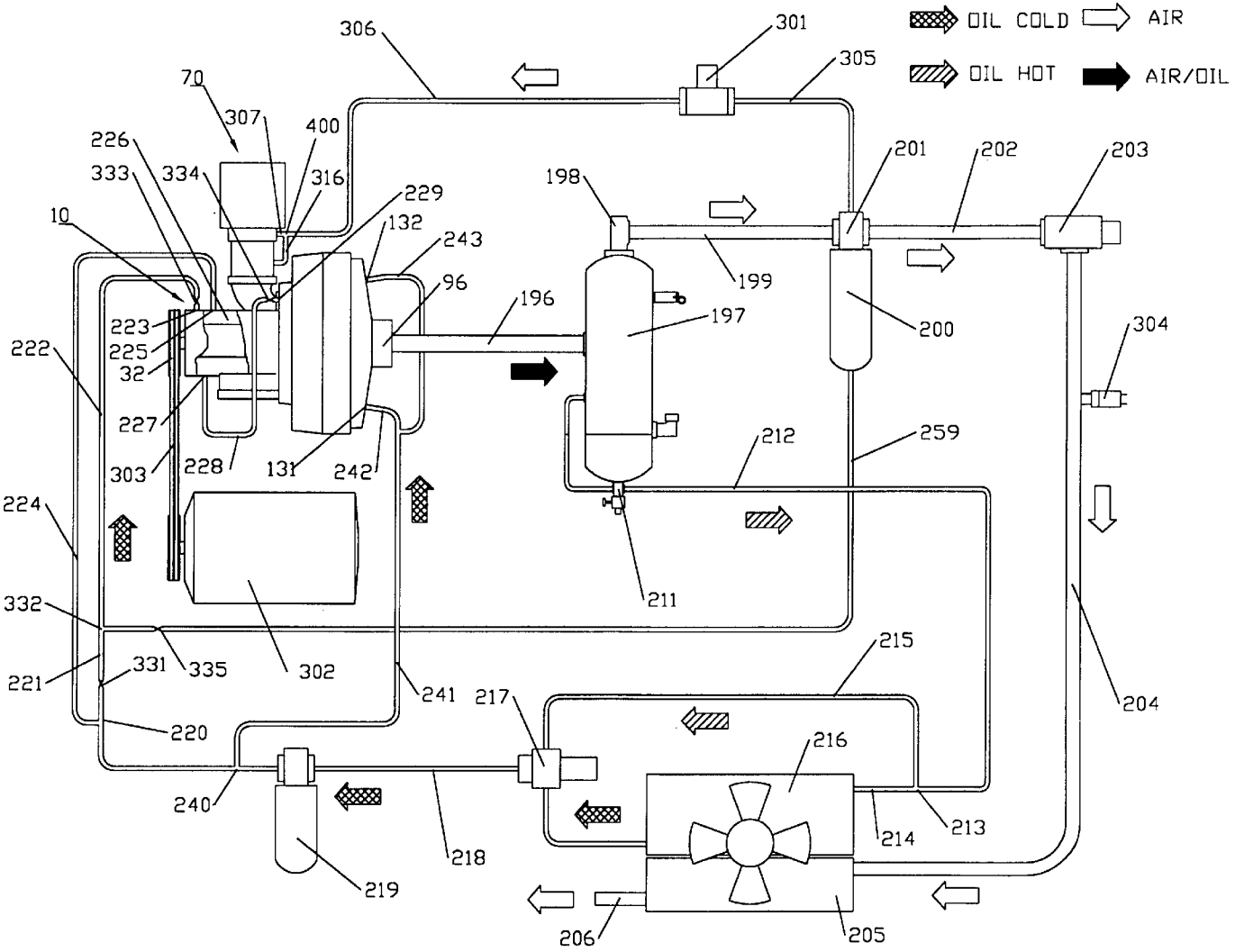
FIG. 4 illustrates a schematic diagram of an oil-gas separation and circulation system for a scroll-type air compressor constructed in accord with the present invention.

Referring now to FIGS. 1 and 4, the oil-air separation and circulation system of the invention will be described. Oil injected from ports 131 and 132 to the compression chambers flows, together with compressed air, through discharge port 96 and pipe 196 (FIG. 4) to oil-air separator/sump 197. A majority of the oil is separated from air and collected in the bottom of the oil-air separator/sump 197. Air containing oil droplets flows through outlet 198 and pipe 199 into coalescent filter 200 where the oil droplets are further separated from air and accumulated at the bottom of coalescent filter 200.

Coalescent filter 200 can be one unit or multiple units in series, depending on the oil carry-over requirement. From the filter 200, the air flows through outlet 201, pipe 202, minimum pressure check valve 203, pipe 204 and air cooler 205 to be cooled down. It then flows to service outlet 206.

Meanwhile, the oil accumulated at the bottom of the oil-air separator/sump 197 is at a high temperature. It must be cooled down such that, after being re-injected into the scroll compression chambers through ports 131 and 132, the oil will maintain a temperature of approximately 110–120° F. above the ambient temperature as it discharges, together with compressed air, through discharge port 96. The oil accumulated at the bottom of the oil-air separator/sump 197 flows through oil outlet 211 and pipe 212 to junction 213. A portion of the hot oil flows through pipe 215 and the remainder flows through pipe 214 and oil cooler 216 for cooling. Oil temperature mixing valve 217 distributes the oil between pipe 214 and pipe 215 to maintain the oil temperature leaving the mixing valve at approximately 140–160° F. The above-mentioned temperature may vary with different lubricant/coolants, of course.

From the mixing valve 217, oil flows through pipe 218 and oil filter 219 to junction 240. From the junction 240 most of the cooled oil flows through pipe 241, and then flows through pipes 242 or 243, to oil injection ports 131 or 132 (FIGS. 1, 2 and 4), respectively. This oil is injected into the scroll compression chambers, as discussed above.

The remaining oil which reaches the junction 240 flows to junction 220. From junction 220 a portion of the oil flows through a throttling orifice 331, a pipe 221, a junction 332, the pipe 222 and an orifice 333 into the oil port 223 of compressor 10 to lubricate shaft bearings 30 and 31 (FIG. 1 and 4).

The oil accumulated in the coalescent filter 200 flows through the pipe 259 and an orifice 335 to junction 332. The orifices 331, 333 and 335 are constructed and arranged such that there is a pressure differential $\Delta p$ between the pressure in the coalescent filter 200 and the pressure at junction 332. The optimum $\Delta p$ is the minimum pressure differential at which all oil accumulated in the coalescent filter 200 can be drained. There are numerous conventional schemes for draining oil accumulated in the coalescent filter 200. In a known manner, the oil accumulated in the coalescent filter 200 can be drained to any location in the oil circulation circuit, as long as it is where the pressure is lower than that in the coalescent filter 200.

Figure 5A:
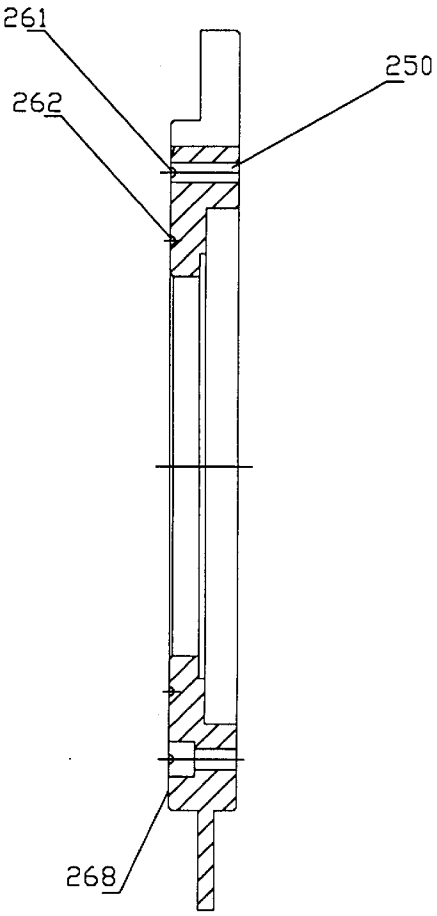
FIG. 5A illustrates a section A—A through FIG. 5.
Figure 5:
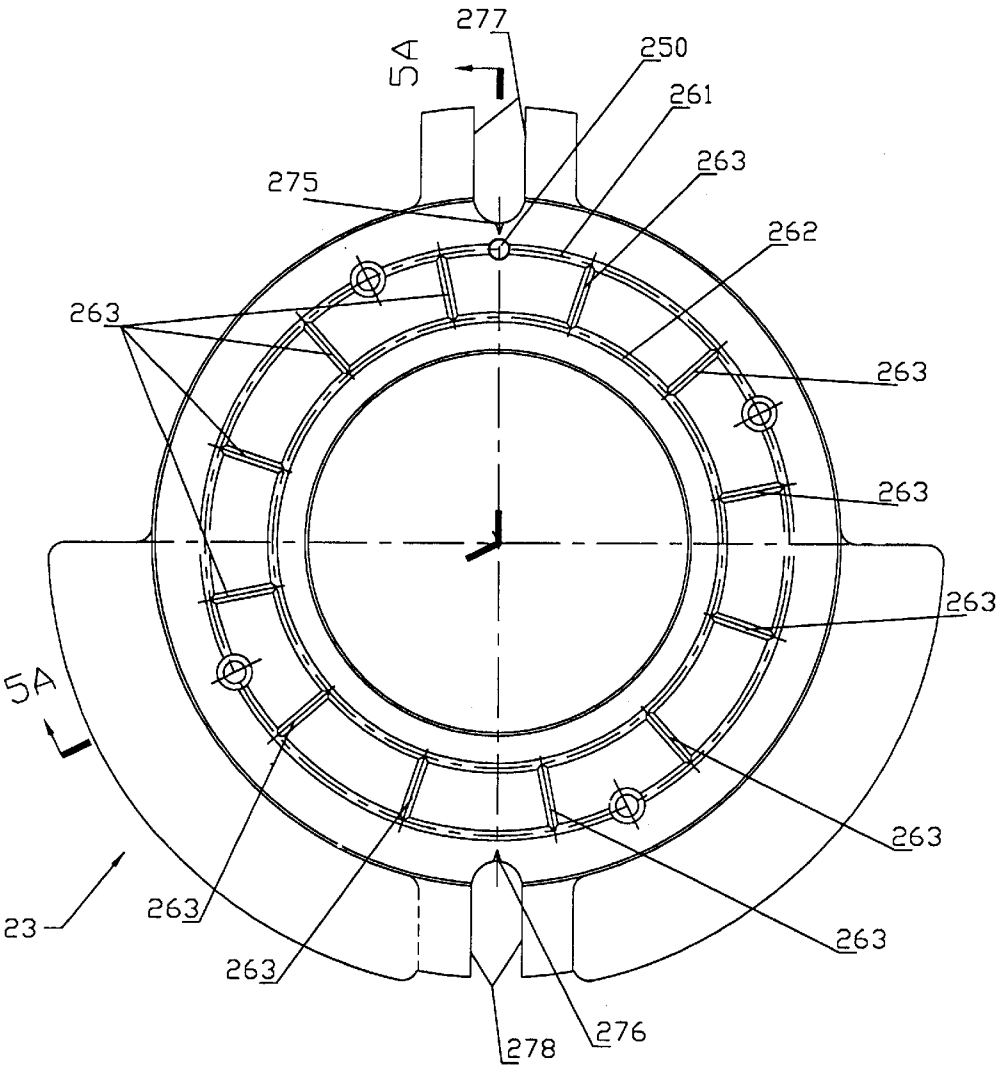
FIG. 5 illustrates a thrust bearing in the compressor of FIG. 1.

Now, referring back to junction 220, the rest of the oil flows through pipe 224 and port 225 (FIG. 1 and 4) into an oil reservoir 226 (FIG. 4). Oil in the reservoir 226 is stored for immediate supply to the thrust bearing surface 268 (FIG. 1) during the start-up period. The oil flows through an outlet port 227, a pipe 228, an orifice 334, a port 229 and the passage 230 in the housing 20 and the passage 250 (FIG. 1 and 5) in the thrust bearing 23 to a circular groove 261 on the thrust surface 268 of thrust bearing 23 (FIG. 5). From the groove 261, oil flows through radial grooves 263 to the circular groove 262. An oil hole 267 on the orbiting scroll end plate 51 (FIG. 1 and 3) periodically communicates with the oil grooves on the thrust bearing 23. Thus, oil flows through the oil hole 267, the passage 264 and the passage 265 to lubricate the bearing 45 (FIG. 1) and to passage 266 to lubricate the drive pin bearing 43.

Grooves 273 and 274 are located on the thrust surface of the orbiting scroll 50 (FIG. 3). The grooves 273 and 274 lead an adequate oil supply to the Oldham ring grooves 271 and 272. The oil grooves 273 and 274 are preferably not connected to any oil grooves on the thrust bearing 23. This is because when the grooves 273 and 274 connect to the grooves 261 and/or 262, and/or 263, there will be more than enough oil flowing to the Oldham ring grooves 271 and 272 to lubricate keys of the Oldham ring (not shown). An excessive oil flow would be a waste of energy.

On the thrust surface of the thrust bearing 23 (FIG. 5) there are two grooves 275 and 276 which have a function similar to grooves 273 and 274 on the orbiting scroll 50. In other words, they also supply oil to the Oldham ring grooves 277 and 278.

Figure 6:
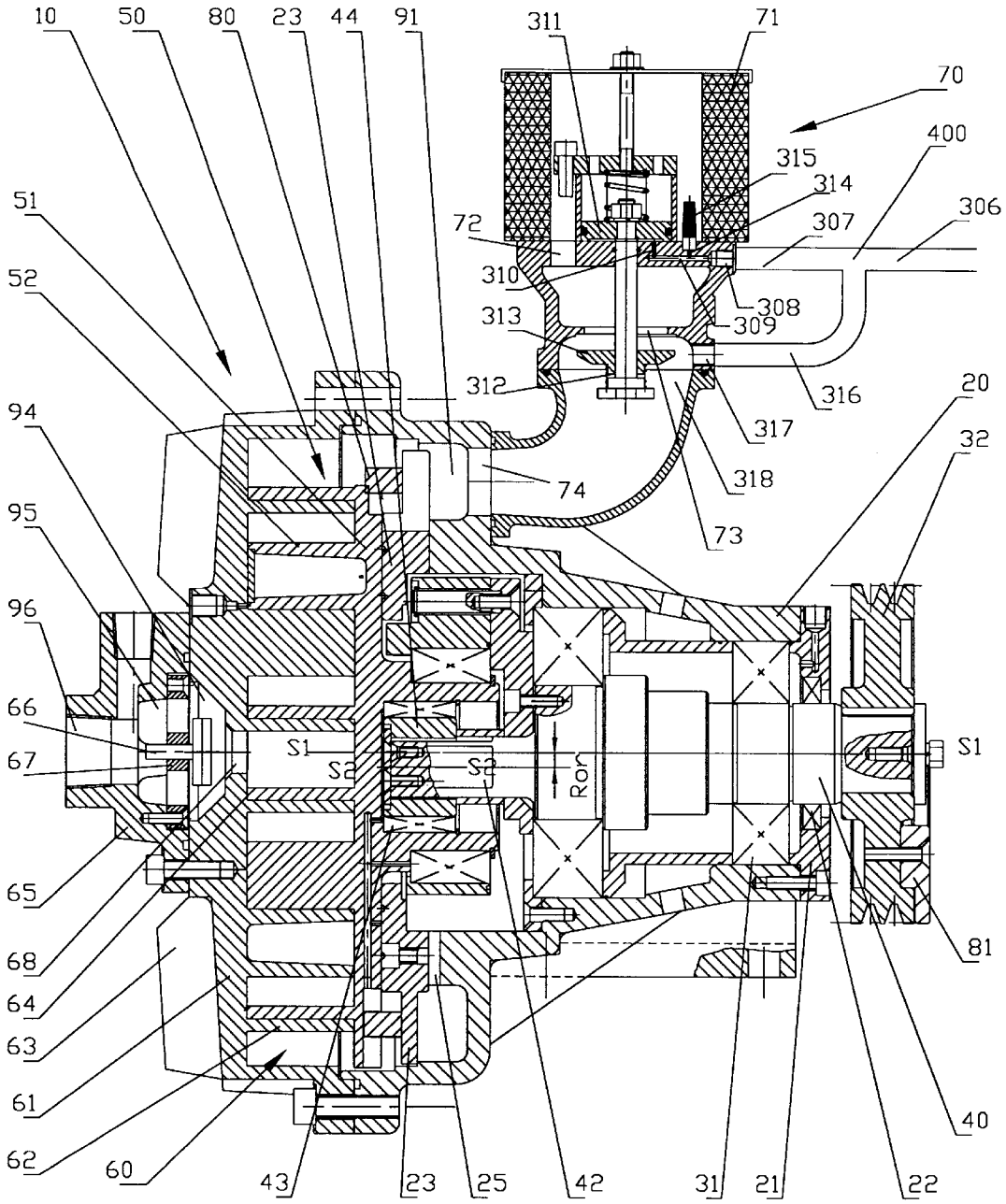
FIG. 6 illustrates an air intake system for the compressor.

Referring now back to FIGS. 1, 4 and 6, the structure and function of the air intake system of the present invention during unload mode, and shut down, will be described. When a select switch (not shown) is turned from the "OFF" position to the "Run, Load/Unload" position, an unload control solenoid valve 301 (FIG. 4) and the motor contactor (not shown) close. A motor 302 drives the compressor 10 via belts 303 and the pulley 32. After the compressor 10 starts, the pressure in the oil-air separator/sump 197 quickly increases to 55 PSIG. The intake valve 70 fully opens, allowing maximum air flow. The rising pressure is isolated from the service line in this phase by the minimum pressure check valve 203, set at approximately 55 PSIG.

When the pressure in the oil-air separator/sump 197 rises above 55 PSIG, the minimum pressure check valve 203 opens and delivers compressed air to the service line via the pipe 204, air cooler 205 and the pipe 206. The line pressure is monitored by an adjustable pressure control switch 304, which is located downstream of the minimum pressure check valve 203. When the demand for compressed air is low, line pressure will continue to build up until it reaches the preset pressure for pressure control switch 304. At this point the pressure control switch 304 opens the circuit controlling the unload control, solenoid valve 301. When solenoid valve 301 opens, air from the coalescent filter 200 flows through the pipe 305, unload control, solenoid valve 301, the pipe 306 and junction 400 (see FIG. 4 and 6). From the junction 400, the first part of the air flows through the pipe 307, the port 308, and the passages 309 and 310 to lift piston 311. This, in turn, pulls the rod 312 and valve 313 to close the intake passage 73.

Orifice 314 and the muffler 315 allow air to be released to ambient to maintain internal air balance during the unload mode. Orifice 314, together with the muffler 315, maintain a pressure differential between the passage 309 and ambient to assure that piston 311, and valve 313, in turn, are lifted and intake air passage 73 is closed.

The second part of the air from the junction 400 flows through the pipe 316, port 317, the chamber 318 and inlet port 74 to reenter compressor 10 for compression. Closing the air inlet passage 73 causes pressure in the oil-air separator/sump 197 (FIG. 4) to decrease. When the pressure in the oil-air separator/sump 197 drops below 55 PSIG, the minimum pressure check valve 203 closes.

During the unload mode the compressed air discharges from the compressor 10 and re-circulates back to the suction chamber of compressor 10 via the pipe 196, the oil-air separator/sump 197, outlet 198, the pipe 199, the coalescent filter 200, outlet 201, the pipe 305, unload control solenoid valve 301, the pipe 306, junction 400, and the pipe 316, port 317 and the inlet port 74 (FIG. 6). The compressor 10 running at unload mode consumes much less energy than in normal operation and does not deliver air to the service line. If there is any leakage in the re-circulation circuit described above, the extra air can be released through the orifice 314 and the muffler 315.

Referring to FIG. 4, during shut down of the compressor 10, the unload control solenoid valve 301 opens and the motor 302 stops. The check valve 66 (FIG. 1 and 6) closes discharge port 68. The air trapped between the compressor discharge port 96 and the minimum pressure check valve 203 flows through the coalescent filter outlet 201, the pipe 305, solenoid valve 301 and the pipe 306 to accomplish three things (FIG. 6):

1. air flows through the pipe 307, port 308, the passages 309 and 310 to push piston 311 and, in turn, to pull rod 312 and valve 313 to shut off intake passage 73 for cutting off intake air;
2. air flows through the pipe 307, port 308, the passages 309, orifice 314 and muffler 315 to release to ambient; and
3. air flows though the pipe 316, chamber 318 and inlet port 74 to reach pressure equilibrium inside compressor 10.

At this time pressure in the pipeline 202 (FIG. 4) decreases to below 55 PSIG and the minimum pressure check valve 203 closes to isolate the downstream pressure from the compressor 10. The shut down process described takes about 10 seconds. After that, the pressure inside the compressor 10 reaches equilibrium and drops down to a preset low pressure. The compressor is then ready for restart.

While the above-described embodiments of the invention are preferred, those skilled in this art will recognize modifications of structure, arrangement, composition and the like which do not part from the true scope of the invention. The invention is defined by the appended claims, and all devices and/or methods that come within the meaning of the claims, either literally or by equivalents, are intended to be embraced therein.

What is claimed is:

1. A scroll-type displacement apparatus comprising:

a first scroll member having a first end plate from a base surface of which first scroll element projects, said first end plate having a discharge port at the central area of said end plate;

a second scroll member having a second end plate from a base surface of which second scroll element projects, said second scroll end plate having a thrust surface parallel to said base of said second scroll member;

a pair of symmetric suction chambers, a pair of compression chambers, and a discharge chamber defined between said first and second scroll members when said first and second scroll members are combined in an eccentric position shifted in phase by 180°;

said first scroll end plate having at least one pair of oil injection ports opening therethrouqh, each oil injection port in said pair opening to said chambers outside of said suction chambers and discharge chamber and shifted in phase by 180°;

a shaft for transmitting a drive force to the second scroll member, said shaft is supported by at least one bearing;

a main housing having a bearing housing supporting said shaft bearings;

an oil-gas separation and circulation system separates oil from discharge gas after said oil-gas mixture discharges from said discharge port of said fixed scroll member, cools down gas and oil, respectively, and re-circulates oil to oil injection ports of said first scroll member wherein:

at least two notches at the tip of said second scroll element, each of said notches meets the corresponding one of said oil injection ports, thus to prevent full blockage of said second scroll element over said oil injection port.

2. A scroll-type fluid displacement apparatus, comprising:

a) a first scroll member including an end plate having a base surface on one side from which a spiral scroll element projects and spirals around the axis of the first scroll member;

b) a second scroll member including an end plate having a base surface on one side from which a spiral scroll element projects and spirals around the axis of the second scroll member;

c) said spiral scroll element of said first scroll member and said spiral scroll element of said second scroll member each having a tip which extends along the length of the corresponding scroll element and is disposed immediately adjacent the base surface of the other scroll member when said scroll members are interfit;

d) said scroll members being interfit in axially eccentric relationship and displaced 180° in phase from each other so as to define a pair of suction chambers and a pair of compression chambers between the scroll elements;

e) said end plate of said first scroll member having two oil injection ports of a first predetermined diameter opening through its base surface, said ports being displaced 180° from each other around the axis of said first scroll member end plate;

f) said second scroll member being mounted for orbiting movement around the axis of said first scroll member;

g) said oil ports being located so they open into said chambers outside of said suction chambers as said second scroll member orbits; and h) at least two fluid passages formed in the tip of said scroll element in said second scroll member, each of said fluid passages communicating simultaneously with a fluid injection port and the nearest one of said compression chambers as said second scroll member orbits, whereby blockage of said ports by said scroll element in said second scroll member is prevented.

3. The scroll-type fluid apparatus of claim 2 further characterized in that:

a) each of said fluid passages comprises a notch formed on one side of the tip.

4. The scroll-type displacement apparatus of claim 3 further characterized in that:

a) said first predetermined diameter of each of said oil ports is less than the thickness of the spiral tip at the location on the tip where the tip orbits over a corresponding port during apparatus operation;

b) the width of the notches being larger than the diameter of corresponding oil ports.

5. The scroll-type displacement apparatus of claim 3 further characterized in that:

a) each of said notches being formed in said spiral tip in a position which causes it to communicate with a corresponding oil port and connects said corresponding oil port to a compression chamber when said tip is in a position which would, in the absence of the notch, block the port during apparatus operation.

6. A scroll-type fluid displacement apparatus, comprising:

a) a first scroll member including an end plate having a base surface on one side from which a spiral scroll element projects and spirals around the axis of the first scroll member;

b) a second scroll member including an end plate having a base surface on one side from which a spiral scroll element projects and spirals around the axis of the second scroll member;

c) said spiral scroll element of said first scroll member and said spiral scroll element of said second scroll member each having a tip which extends along the length of the corresponding scroll element and is disposed immediately adjacent the base surface of the other scroll member when said scroll members are interfit;

d) said scroll members being interfit in axially eccentric relationship and displaced 180° in phase from each other so as to define a suction chamber and a compression chamber between the scroll elements;

e) said end plate of said first scroll member having an oil injection port of a first predetermined diameter opening through its base surface;

f) said second scroll member being mounted for orbiting movement around the axis of said first scroll member;

g) said oil port being located so it opens into said chambers outside of said suction chamber as said second scroll member orbits; and h) a fluid passage formed in the tip of said scroll element in said second scroll member, said fluid passage communicating simultaneously with a fluid injection port and said compression chamber as said second scroll member orbits, whereby blockage of said port by said scroll element in said second scroll member is prevented.

7. The scroll-type fluid apparatus of claim 6 further characterized in that:

a) each fluid passage comprises a notch formed on one side of the tip.

8.The scroll-type displacement apparatus of claim 7 further characterized in that:

a) said first predetermined diameter of said oil port is less than the thickness of the spiral tip at the location on the tip where the tip orbits over said port during apparatus operation;

b) the width of the notch being larger than the diameter of said oil port.

9. The scroll-type displacement apparatus of claim 7 further characterized in that:

a) said notch being formed in said spiral tip in a position which causes it to communicate with said oil port and connects said oil port to a compression chamber when said tip is in a position which would, in the absence of the notch, block the port during apparatus operation.

* * * * *